US006384009B1

(12) United States Patent
Koester et al.

(10) Patent No.: US 6,384,009 B1
(45) Date of Patent: May 7, 2002

(54) USE OF ALKOXYLATED CARBOXYLIC ACID ESTERS FOR REDUCING VISCOSITY OF AQUEOUS SURFACTANT SYSTEMS

(75) Inventors: Rita Koester, Duesseldorf; Ansgar Behler, Bottrop; Michael Neuss, Cologne; Karl-Heinz Schmid, Mettmann, all of (DE)

(73) Assignee: Cognis Deutschland GmbH, Duesseldorf (DE)

( * ) Notice: Subject to any disclaimer, the term of this patent is extended or adjusted under 35 U.S.C. 154(b) by 0 days.

(21) Appl. No.: 09/787,725

(22) PCT Filed: Sep. 11, 1999

(86) PCT No.: PCT/EP99/06744

§ 371 Date: Jun. 18, 2001

§ 102(e) Date: Jun. 18, 2001

(87) PCT Pub. No.: WO00/17295

PCT Pub. Date: Mar. 30, 2000

(30) Foreign Application Priority Data

Sep. 22, 1998 (DE) ..... 198 43 384

(51) Int. Cl.[7] ..... C11D 1/72

(52) U.S. Cl. ..... 510/421; 510/422; 510/437; 510/488; 510/491; 510/505; 510/506; 510/356

(58) Field of Search ..... 510/421, 422, 510/437, 488, 491, 505, 506, 356

(56) References Cited

U.S. PATENT DOCUMENTS

| | | | | |
|---|---|---|---|---|
| 1,985,424 A | | 12/1934 | Piggott | 260/124 |
| 2,016,962 A | | 10/1935 | Flint et al. | 260/127 |
| 2,703,798 A | | 3/1955 | Schwartz | 260/211 |
| 3,915,867 A | | 10/1975 | Kang et al. | 252/8.8 |
| 4,370,272 A | | 1/1983 | Wechsler et al. | 260/404 |
| 5,681,803 A | * | 10/1997 | Okano et al. | 510/130 |
| 5,753,606 A | * | 5/1998 | Hees et al. | 510/422 |
| 5,880,086 A | | 3/1999 | Weinelt et al. | 510/504 |
| 6,008,392 A | * | 12/1999 | Behler et al. | 554/149 |

FOREIGN PATENT DOCUMENTS

| | | |
|---|---|---|
| DE | 39 14 131 | 10/1990 |
| DE | 43 26 112 | 2/1995 |
| DE | 196 11 999 | 7/1997 |
| EP | 0 182 017 | 5/1986 |
| EP | 0 239 910 | 10/1987 |
| EP | 0 293 955 | 12/1988 |
| EP | 0 295 739 | 12/1988 |
| EP | 0 309 052 | 3/1989 |
| EP | 0 691 396 | 1/1996 |
| EP | 0 819 755 | 1/1998 |
| WO | WO92/01971 | 2/1992 |
| WO | WO92/06984 | 4/1992 |
| WO | WO93/09111 | 5/1993 |
| WO | WO93/23510 | 11/1993 |
| WO | WO94/13618 | 6/1994 |
| WO | WO98/01524 | 1/1998 |
| WO | WO99/10460 | 3/1999 |

OTHER PUBLICATIONS

H. Kelkenberg, "Bentonite," Tenside Surfactants Detergents, 25, 8, pp. 14–20 (1988).

U. Ploog, "Kosmetika Aerosole Riechstoffe," Seifen–Öle–Fette–Wachse, 198, pp. 373–376, (1982).

* cited by examiner

*Primary Examiner*—Charles Boyer
(74) *Attorney, Agent, or Firm*—John E. Drach; Steven J. Trzaska

(57) ABSTRACT

A process for reducing the viscosity of an aqueous surfactant composition involving: (a) providing an aqueous surfactant composition containing at least one surfactant, other than an alkoxylated carboxylic acid ester; (b) providing a viscosity-reducing agent corresponding to formula (I):

(I)

$$R^1\underset{\underset{O}{\|}}{C}(OAlk)_nOR^2$$

wherein $R^1CO$ is an aliphatic acyl group containing from 6 to 18 carbon atoms, AlkO represents $CH_2CH_2O$—, $CHCH_3CH_2O$—, $CH_2$—$CHCH_3O$, n is a number from 3 to 15, and $R^2$ is an aliphatic alkyl group having from 1 to 22 carbon atoms; and (c) adding a viscosity-reducing effective amount of the viscosity-reducing agent to the aqueous surfactant composition.

12 Claims, No Drawings

USE OF ALKOXYLATED CARBOXYLIC ACID ESTERS FOR REDUCING VISCOSITY OF AQUEOUS SURFACTANT SYSTEMS

BACKGROUND OF THE INVENTION

This invention relates to the use of alkoxylated carboxylic acid esters, more particularly those which have been obtained by reaction of carboxylic acid esters and alkylene oxides in the presence of calcined hydrotalcites, for reducing the viscosity of aqueous surfactant systems, more particularly those for the production of liquid laundry detergents, dishwashing detergents and cleaners.

Nowadays, liquid laundry detergents, dishwashing detergents and cleaners are expected to meet a whole range of very different requirements. Thus, they are supposed inter alia to be formulated with a high active substance content and, at the same time, to be liquid or at least flowable. Thus, the end user looks above all for flowable dishwashing detergents and cleaners so that the compositions can be precisely dosed as required, above all without any particular physical effort, and completely emptied. The manufacturers of such products also prefer free-flowing types because they are easier to formulate and package. In many cases, however, the surfactants always present in the compositions in question are paste-form products of which the viscosity has to be reduced accordingly so that the requirements can be fulfilled. In some cases, viscosity can be reduced by large quantities of water as solvent. In other cases, solubilizers, such as ethanol, ethylene glycol, diethylene glycol or even monobutyl diglycol ethers, are used to obtain the required viscosities. However, these solvents and solubilizers have to be used in large quantities so that the required viscosities are obtained, greatly reducing the active substance content of the compositions. In addition, the solvents and solubilizers on their own do not contribute towards the cleaning performance of the laundry detergents, dishwashing detergents and cleaners.

Now, the complex problem addressed by the present invention was to provide compounds which would be capable, even in small quantities, of greatly reducing the viscosity of aqueous surfactant systems. At the same time, these viscosity-reducing compounds would contribute towards the cleaning performance of the compositions.

Accordingly, the present invention relates to the use of alkoxylated carboxylic acid esters for reducing the viscosity of aqueous surfactant systems.

Alkoxylated carboxylic acid esters obtained by homogeneous catalysts in the presence of hydroxides and reducing agents or a co-catalyst catalyst are known from DE-A1-19 611 999 and International Patent Application WO 94/13618. According to both documents, the compounds in question may be used in laundry detergents, dishwashing detergents and cleaners.

DE-A-43 26 112 describes low-foaming multipurpose cleaners containing alkoxylated carboxylic acid esters in admixture with alkyl glycosides and optionally other surfactants, such as alkyl sulfates, alkyl ether sulfates and fatty alcohol polyglycol ethers.

However, there are no references in any of the documents cited above to the effectiveness of alkoxylated carboxylic acid esters in reducing the viscosity of aqueous surfactant systems.

DETAILED DESCRIPTION OF THE INVENTION

It has now surprisingly been found that, even when used in small quantities, alkoxylated carboxylic acid esters are capable of considerably lowering the viscosity of aqueous surfactant systems without reducing their high active substance content in the way that conventional solvents do.

Alkoxylated Carboxylic Acid Testers

According to the invention, the alkoxylated carboxylic acid esters are used above all in aqueous surfactant systems which—without the addition of viscosity-reducing solvents—have a Höppler viscosity (at 20° C) of more than 750 mPas and preferably more than 1000 mPas. A reduction in viscosity in the context of the invention occurs when the viscosity of the aqueous surfactant system is reduced preferably by one third and more particularly by at least half, based on the Höppler viscosity of the aqueous surfactant system without alkoxylated carboxylic acid esters.

The alkoxylated carboxylic acid esters used are known from the prior art. They may be obtained, for example, by esterification of alkoxylated carboxylic acids with alcohols. For the purposes of the present invention, however, the compounds are produced by reaction of carboxylic acid esters with alkylene oxides using catalysts, more especially calcined hydrotalcite in accordance with DE-A-39 14 131, which give compounds with a narrow homolog distribution. Carboxylic acid esters of both monohydric alcohols and dihydric alcohols can be alkoxylated by this process. Alkoxylated carboxylic acid esters of monohydric alcohols corresponding to general formula (I):

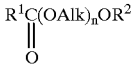

$$R^1C(=O)(OAlk)_nOR^2 \quad (I)$$

in which $R^1CO$ is an aliphatic acyl group derived from a carboxylic acid, AlkO stands for alkylene oxide and $R^2$ is an aliphatic alkyl group derived from a monohydric aliphatic alcohol, are preferred for the purposes of the invention. Alkoxylated carboxylic acid esters of formula (I), in which $R^1CO$ is an aliphatic acyl group containing 6 to 18 carbon atoms, OAlk stands for a $CH_2CH_2O$—, $CHCH_3CH_2O$— and/or $CH_2$—$CHCH_3O$ group, n has an average value of 3 to 15 and $R^2$ is an aliphatic alkyl group containing 1 to 22 carbon atoms, are particularly suitable.

Preferred acyl groups are derived from carboxylic acids containing 6 to 18 carbon atoms of natural or synthetic origin, more especially from linear, saturated and/or unsaturated fatty acids, including the technical mixtures thereof obtainable by lipolysis from animal and/or vegetable fats and oils (optionally with subsequent separation of fatty acid), for example from coconut oil, palm kernel oil, palm oil, soya oil, sunflower oil, rapeseed oil, cottonseed oil, fish oil, bovine tallow and lard. Examples of such carboxylic acids are caproic acid, caprylic acid, 2-ethyl hexanoic acid, capric acid, lauric acid, isotridecanoic acid, myristic acid, palmitic acid and/or palmitoleic acid.

Preferred alkyl groups $R^2$ are derived from primary, aliphatic monohydric alcohols containing 1 to 22 carbon atoms which may be saturated and/or unsaturated. Examples of suitable monoalcohols are methanol, ethanol, propanol, butanol, pentanol and the hydrogenation products of the above-mentioned carboxylic acids containing 6 to 22 carbon atoms, more particularly methanol.

AlkO stands for the alkylene oxides which are reacted with the carboxylic acid esters and which comprise ethylene oxide, propylene oxide and/or butylene oxides, preferably ethylene oxide and/or propylene oxide and more particularly ethylene oxide on its own.

One embodiment is characterized by the use of alkoxylated carboxylic acid esters of formula (I), in which $R^1CO$ is an aliphatic acyl group containing 6 to 10 carbon atoms, AlkO stands for a $CH_2CH_2O$ group, n has an average value of 5 to 15 and $R^2$ is a methyl group. Examples of such compounds are caprylic acid methyl ester and 2-ethyl hexanoic acid methyl ester alkoxylated with, on average, 5, 7, 9 or 11 moles of ethylene oxide. Another embodiment is characterized by the use of alkoxylated carboxylic acid esters of formula (I), in which $R^1CO$ is an aliphatic acyl group containing 12 to 14 carbon atoms, OAlk stands for a $CH_2CH_2O$ group, n has an average value of 8 to 12 and $R^2$ is a methyl group.

Anionic Surfactants

The alkoxylated carboxylic acid esters are capable of reducing the viscosity of surfactant systems containing anionic surfactants. Typical examples of anionic surfactants are soaps, alkyl benzenesulfonates, alkane sulfonates, olefin sulfonates, alkyl ether sulfonates, glycerol ether sulfonates, a-methyl ester sulfonates, sulfofatty acids, alkyl sulfates, alkylether sulfates, glycerol ether sulfates, monoglyceride (ether) sulfates, hydroxy mixed ether sulfates, fatty acid amide (ether) sulfates, mono- and dialkyl sulfosuccinates, mono- and dialkyl sulfosuccinamates, sulfo-triglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (more particularly vegetable wheat-based products) and alkyl (ether)phosphates. Where the anionic surfactants contain polyglycol ether chains, they may have a conventional homolog distribution although they preferably have a narrow homolog distribution. The alkoxylated carboxylic acid esters are preferably used in surfactant systems containing anionic surfactants selected from the group consisting of alkyl sulfates, alkyl ether sulfates, alkane sulfonates, monoglyceride sulfates, sulfosuccinates and fatty acid polyglycol ester sulfates.

Preferred fatty acid polyglycol ester sulfates are compounds which are obtained by sulfation in known manner of fatty acid alkoxylates onto which an average of 1 to 3 moles of alkylene oxide have been added. Fatty acid alkoxylates such as these are obtainable by addition of alkylene oxide, preferably ethylene oxide, onto fatty acids in the presence of bases, such as sodium methylate or triethanolamine or calcined hydrotalcite.

Preferred alkyl sulfates and alkylether sulfates are compounds which contain 12 to 18 carbon atoms in the alkyl moiety and onto which 3 to 15 moles of ethylene oxide have optionally been added. Compounds such as these are commercially available surfactants of which the production is known from the prior art.

In a particularly preferred embodiment, the alkoxylated carboxylic acid esters are used for reducing the viscosity of aqueous alkyl sulfate pastes of the type already described.

Nonionic Surfactants

The alkoxylated carboxylic acid esters are capable of reducing the viscosity of surfactant systems containing nonionic surfactants. Typical examples of nonionic surfactants are fatty alcohol polyglycol ethers, alkyl phenol polyglycol ethers, fatty acid amide polyglycol ethers, fatty amine polyglycol ethers, alkoxylated triglycerides, alk(en)yl oligoglycosides, fatty acid-N-alkyl glucamides, protein hydrolyzates (more particularly wheat-based vegetable products), polyol fatty acid esters, sugar esters, sorbitan esters, polysorbates and amine oxides. Where the nonionic surfactants contain polyglycol ether chains, they may have a conventional homolog distribution although they preferably have a narrow homolog distribution. The alkoxylated carboxylic acid esters are preferably used in aqueous surfactant systems containing fatty alcohol polyglycol ethers, alkyl oligoglucosides, fatty acid-N-alkyl glucamides and/or amine oxides as nonionic surfactants.

They are particularly suitable for aqueous surfactant systems of alkyl and alkenyl oligoglycosides corresponding to formula (II):

$$R^3O—[G]_p \qquad \text{(II)}$$

in which $R^3$ is an alkyl and/or alkenyl radical containing 4 to 22 carbon atoms, G is a sugar unit containing 5 or 6 carbon atoms and p is a number of 1 to 10. They may be obtained by the relevant methods of preparative organic chemistry.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (II) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^3$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^3$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut fatty alcohol with a DP of 1 to 3 are preferred.

The viscosity-reducing alkoxylated carboxylic acid esters are also suitable for aqueous surfactant systems containing fatty acid-N-alkyl polyhydroxyalkylamides which correspond to formula (Ill):

$$R^5CO—\overset{\overset{\displaystyle R^4}{|}}{N}—[Z] \qquad \text{(III)}$$

where $R^5CO$ is an aliphatic acyl group containing 6 to 22 carbon atoms, $R^4$ is an alkyl or hydroxyalkyl group containing 1 to 4 carbon atoms and [Z] is a linear or branched polyhydroxyalkyl group containing 3 to 12 carbon atoms and 3 to 10 hydroxyl groups. The fatty acid-N-alkyl polyhydroxyalkylamides are known compounds which may normally be obtained by reductive amination of a reducing sugar with an alkylamine or an alkanolamine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in International patent application WO 92/06984. An overview of this subject by H. Kelkenberg can be found in Tens. Surf. Det. 25, 8(1988).

The fatty acid-N-alkyl polyhydroxyalkylamides are preferably derived from reducing sugars containing 5 or 6 carbon atoms, more particularly from glucose. Accordingly, the preferred fatty acid-N-alkyl polyhydroxy-alkylamides are fatty acid-N-alkyl glucamides which correspond to formula (IV):

(IV)

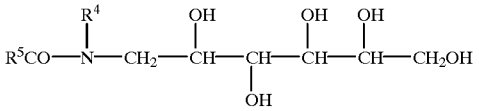

Preferred fatty acid-N-alkyl polyhydroxyalkylamides are glucamides corresponding to formula (IV) in which $R^4$ is an alkyl group and $R^5CO$ represents the acyl component of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof. Fatty acid-N-alkyl glucamides (IV) obtained by reductive amination of glucose with methylamine and subsequent acylation with lauric acid or $C_{12/14}$ cocofatty acid or a corresponding derivative are particularly preferred. In addition, the polyhydroxyalkylamides may also be derived from maltose and palatinose.

The alkoxylated carboxylic acid esters are also suitable for reducing the viscosity of aqueous surfactant systems containing fatty alcohol polyglycol ethers. The fatty alcohol polyglycol ethers are in particular addition products of 2 to 10 moles of ethylene oxide onto fatty alcohols containing 12 to 18 carbon atoms, addition products of 2 to 10 moles of ethylene oxide and 1 to 3 moles of propylene oxide and/or butylene oxide onto fatty alcohols containing 12 to 18 carbon atoms and methyl- or butyl-end-capped addition products of 2 to 10 moles of ethylene oxide onto fatty alcohols containing 12 to 18 carbon atoms and addition products of 2 to 10 moles of ethylene oxide and 1 to 3 moles of propylene oxide and/or butylene oxide onto fatty alcohols containing 12 to 18 carbon atoms.

In another embodiment, the alkoxylated carboxylic acid esters may be used for reducing the viscosity of aqueous surfactant systems containing amine oxides. Amine oxides are produced from tertiary fatty amines which normally have one long and two short or two long and one short alkyl chain by oxidation in the presence of hydrogen peroxide. The amine oxides suitable for the purposes of the invention correspond to formula (V):

(V)

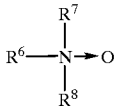

in which $R^6$ is a linear or branched alkyl group containing 12 to 18 carbon atoms and $R^7$ and $R^8$ independently of one another have the same meaning as $R^6$ or represent an optionally hydroxy-substituted alkyl group containing 1 to 4 carbon atoms. Amine oxides corresponding to formula (V), in which $R^6$ and $R^7$ represent $C_{12/14}$ or $C_{12/18}$ cocoalkyl radicals and $R^8$ is a methyl group or a hydroxyethyl group, are preferably used. Amine oxides corresponding to formula (V), in which $R^6$ is a $C_{12/14}$ or $C_{12/18}$ cocoalkyl group and $R^7$ and $R_8$ represent a methyl or hydroxyethyl group, are also preferred.

Amphoteric or Zwitterionic Surfactants

The alkoxylated carboxylic acid esters are capable of reducing the viscosity of surfactant systems containing amphoteric or zwitterionic surfactants. Typical examples of amphoteric or zwitterionic surfactants are alkyl betaines, alkyl amidobetaines, aminopropionates, imidazolinium betaines and sulfobetaines.

Betaines are known surfactants which are mainly produced by carboxyalkylation, preferably carboxymethylation, of aminic compounds. The starting materials are preferably condensed with halocarboxylic acids or salts thereof, more particularly with sodium chloroacetate, 1 mole of salt being formed per mole of betaine. The addition of unsaturated carboxylic acids, for example acrylic acid, is also possible. Particulars of the nomenclature and, in particular, the distinction between betaines and "genuine" amphoteric surfactants can be found in the article by U. Ploog in Seifen-Öle-Fette-Wachse, 198, 373 (1982). Examples of suitable betaines are the carboxyalkylation products of secondary and, in particular, tertiary amines corresponding to formula (VI):

(VI)

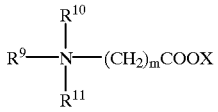

in which $R^9$ stands for alkyl and/or alkenyl groups containing 6 to 22 carbon atoms, $R^{10}$ stands for hydrogen or alkyl groups containing 1 to 4 carbon atoms, $R^{11}$ stands for alkyl groups containing 1 to 4 carbon atoms, m is a number of 1 to 6 and X is an alkali metal and/or alkaline earth metal or ammonium. Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine and technical mixtures thereof. Other suitable betaines are carboxyalkylation products of amidoamines (so-called glycinates) corresponding to formula (VII):

(VII)

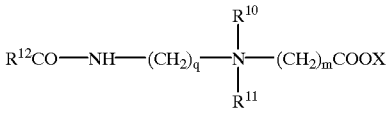

in which $R^{12}CO$ is an aliphatic acyl group containing 6 to 22 carbon atoms and 0 or 1 to 3 double bonds, q is a number of 1 to 3 and $R^{10}$, $R^{11}$, m and X are as defined above for formula (VI). Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethyl aminoethyl amine, N,N-dimethyl aminopropyl amine, N,N-diethyl aminoethyl amine and N,N-diethyl aminopropyl amine which are condensed with sodium chloroacetate. It is preferred to use a condensation product of $C_{8/18}$ cocofatty acid-N,N-dimethyl aminopropyl amide with sodium chloroacetate. Other suitable betaines are imidazolines corresponding to formula (VIII):

(VIII)

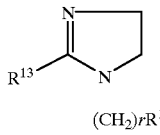

in which $R^{13}$ is an alkyl group containing 5 to 21 carbon atoms, $R^{14}$ is a hydroxyl group, an $OCOR^{13}$ or $NHCOR^{13}$ group and r=2 or 3. Imidazolines are also known compounds which may be obtained, for example, by cyclizing condensation of 1 or 2 moles of fatty acid with polyfunctional amines, for example aminoethyl ethanolamine (AEEA) or diethylene triamine. The corresponding carboxyalkylation products are mixtures of different open-chain betaines. Typical examples are condensation products of the above-mentioned fatty acids with AEEA, preferably imidazolines based on lauric acid or—again—$C_{12/14}$ cocofatty acid which are subsequently betainized with sodium chloroacetate.

The alkoxylated carboxylic acid esters are used in quantities of preferably 0.1 to 20% by weight and more preferably 5 to 15% by weight, based on the active substance content of the surfactants. The aqueous surfactant systems contain at least one anionic, nonionic or amphoteric or zwitterionic surfactant. The aqueous surfactant systems preferably contain at least one anionic and/or nonionic surfactant and optionally an amphoteric or zwitterionic surfactant. The ratio by weight of the surfactants to one another is not critical. In one embodiment, the aqueous surfactant systems contain 1 to 30% by weight and preferably 5 to 20% by weight of nonionic surfactants, preferably fatty alcohol polyglycol ethers, alkyl oligoglycosides and/or amine oxides and 0 to 15% by weight and preferably 1 to 15% by weight of alkyl betaines and/or alkyl amidobetaines, expressed as the active substance content of the surfactants and based on the aqueous surfactant system.

In one preferred embodiment of the present invention, the aqueous surfactant systems contain 5 to 35% by weight and more particularly 7 to 20% by weight of anionic surfactants, preferably alkyl sulfates, alkyl ether sulfates, alkanesulfonates, monoglyceride sulfates, sulfosuccinates and fatty acid polyglycol ester sulfates, and 0 to 25% by weight and more particularly 5 to 10% by weight of nonionic surfactants, preferably fatty alcohol polyglycol ethers, alkyl oligoglycosides and/or amine oxides and 0 to 15% by weight and more particularly 1 to 15% by weight of alkyl betaines and/or alkyl amidobetaines, expressed as the active substance content of the surfactants and based on the aqueous surfactant system.

In all, the aqueous surfactant systems contain preferably 10 to 45% by weight, more preferably 10 to 40% by weight and most preferably 15 to 40% by weight of surfactants, expressed as active substance content and based on the aqueous surfactant system. In addition, the alkoxylated carboxylic acid esters are present in the aqueous surfactant systems in the quantities already described. It is pointed out here that, in the context of the invention, the alkoxylated carboxylic acid esters are not classed as nonionic surfactants because they are used as viscosity-reducing agents. In the most simple case, the balance to 100% by weight of the aqueous surfactant systems can be water or even—depending on the intended application—water and the usual auxiliaries.

The alkoxylated carboxylic acid esters are used in aqueous surfactant systems which are preferably used for the production of laundry detergents, dishwashing detergents and cleaners, more particularly manual dishwashing detergents, multipurpose cleaners, glass cleaners, floor cleaners, liquid detergents, toilet cleaners, bath cleaners and automatic dishwasher detergents. Commensurate with this application, typical auxiliaries, such as builders, for example glutaric acid, succinic acid, adipic acid, tartaric acid, gluconic acid, trisodium citrate, solvents, for example acetone or ethanol, hydrotropes, for example cumenesulfonate, butyl glucoside, butylene glycol, preservatives, pH adjusters, for example citric acid, dyes and perfumes, opacifiers and antimicrobial agents, may be added to the aqueous surfactant systems.

If antimicrobial manual dishwashing detergents are required, it is recommended to add quaternized ammonium compounds, quaternary fatty acid triethanolamine ester salts (esterquats) and/or aromatic alcohols.

Suitable aromatic alcohols are special phenol derivatives which are described in International patent application WO-A-98/01524 and which are commercially available under the name of Triclosan®. Suitable quaternized ammonium compounds are quaternary alkylamines containing 6 to 22 carbon atoms in the alkyl moiety which have been known for some time as so-called QUATS. Suitable esterquats are compounds corresponding to the following formula:

(IX)

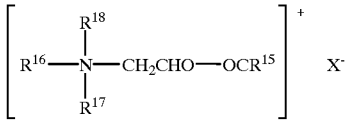

in which $R^{15}CO$ is an acyl group containing 2 to 16 carbon atoms, $R^{16}$ and $R^{17}$ independently of one another represent an alkyl group containing 1 to 16 carbon atoms or a group with the formula $CH_2—CH_2—O—R^{19}$, $R^{18}$ is an alkyl group containing 1 to 4 carbon atoms, $R^{19}$ is hydrogen and/or $R^{15}CO$ and X– is an anion.

They are generally prepared by esterification of the alkanolamines with carboxylic acids in the presence of hypophosphorous acid as catalyst, passing air through the reaction mixture and then quaternizing the esterification product. U.S. Pat. Nos. 3,915,867, 4,370,272, EP-A-0 239 910, EP-A-0 293 955, EP-A-0 295 739 and EP-A-0 309 052 are cited here are representative of the abundant prior art available on the subject.

The quaternized carboxylic acid alkanolamine ester salts are prepared by methods known per se, alkanolamines corresponding to formula (X):

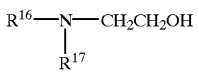

(X)

in which $R^{16}$ and $R^{17}$ are as defined for formula (IX), with the proviso that, where $R^{16}$ and/or $R^{17}$ represent(s) the group $CH_2CH_2OR^{19}$, $R^{19}$ is hydrogen, being esterified with carboxylic acids corresponding to the formula $R^{15}COOH$. Suitable alkanolamines are dialkyl ethanolamines ($R^{16}$, $R^{17}$=alkyl group containing 1 to 16 carbon atoms), such as dimethyl ethanolamine, methylethyl ethanolamine, diethyl ethanolamine, methylbutyl ethanolamine and/or methylhexyl ethanolamine, monoalkyl diethanolamines ($R^{16}$=$CH_2CH_2OH$; $R^{17}$=$C_{1-16}$ alkyl group), such as methyl diethanolamine, ethyl diethanolamine and/or butyl diethanolamine, and/or triethanolamines ($R^{16}$, $R^{17}$=$CH_2CH_2OH$). Monoalkyl diethanolamines and/or triethanolamines are preferably used.

Suitable carboxylic acids $R^{15}COOH$ are aliphatic saturated carboxylic acids, such as acetic acid, propionic acid, butyric acid, caproic acid, caprylic acid, capric acid, pelargonic acid, lauric acid, myristic acid, palmitic acid and the technical mixtures thereof obtained, for example, in the pressure hydrolysis of natural fats and oils. Aliphatic saturated carboxylic acids containing 8 to 12 carbon atoms are preferred so that $R^{15}CO$ in formula (I) is preferably an aliphatic saturated acyl group containing 8 to 12 carbon atoms.

The quantity ratio of carboxylic acids to the alkanolamines is determined by the required degree of esterification of the free hydroxyl groups of the alkanolamines. In the case of the preferred monodiethanolamines and triethanolamines, all or only some of the free hydroxyl groups can be esterified with the carboxylic acids. If the hydroxyl group is not esterified, $R^{19}$ in general formula (IX) stands for a hydrogen atom. If the hydroxyl group is esterified, $R^{19}$ in general formula (IX) stands for $R^{15}CO$. Where esterification is partial, the average degree of esterification of the—overall—free hydroxyl groups in the case of the monodiethanolamines is preferably in the range from 1.2 to 1.7 and, in the case of the triethanolamines, is preferably in the range from 1.5 to 1.9, i.e. mixtures of mono-, di- and optionally triesters of the di- or triethanolamines with carboxylic acids are present. According to the invention, all the free hydroxyl groups of the alkanolamines are esterified with carboxylic acids.

The subsequent quaternization is carried out by the methods known in this field and leads to the quaternized carboxylic acid alkanolamine ester salts corresponding to general formula (IX). Compounds with the formula $R^{18}X$, where $R^{18}$ is as defined for formula (IX) and preferably stands for a methyl group, are used for the quaternization. X in general formula (I) stands for an anion preferably selected from the group consisting of methosulfate, ethosulfate, formate, acetate, tartrate, dicarboxylate, citrate, halide, sulfate, phosphate and nitrate.

According to the invention, it is particularly preferred to use compounds of formula (IX), in which $R^{16}$ is a group $CH_2CH_2O—OCR^{15}$ and $R^{17}$ is a methyl group and/or in which $R^{16}$ and $R^{17}$ stand for a group $CH_2CH_2O—OCR^{15}$ where $R^{15}$ is as previously defined, as antimicrobial agents. Examples of particularly suitable compounds are dimethyl diethanolammonium dicaprylic acid ester methosulfate, methyl triethanolammonium tricaprylic acid ester methosulfate and dimethyl diethanolammonium dipelargonic acid ester methosulfate.

The microbicidal agents may advantageously be used in quantities of 0.1 to 5% by weight, expressed as active substance and based on the particular composition.

The aqueous surfactant systems according to the invention may be formulated as required in liquid form or as concentrates.

EXAMPLES

1. Ethoxylated Fatty Acid Methyl Esters Used

The following ethoxylated fatty acid methyl esters were prepared using calcined hydrotalcite as described in DE-A-39 14 131, the number of moles of ethylene oxide (EO) added on representing mean values:

A) $C_{12/14}$ fatty acid+9 EO methyl ester (ratio by weight 70% by weight $C_{12}$ to 30% by weight $C_{14}$)

B) $C_{6-10}$ fatty acid+5 EO methyl ester (ratio by weight 3–10% by weight $C_6$ to 30–50% by weight $C_{10}$)

C) $C_{6-10}$ fatty acid+7 EO methyl ester (ratio by weight: $C_{6-10}$ fatty acid as in B)

D) $C_{6-10}$ fatty acid+9 EO methyl ester (ratio by weight: $C_{6-10}$ fatty acid as in B)

2. Performance Tests

The Höppler viscosity of the aqueous surfactant systems in mPas was determined at 20° C.

Formulations 1 to 4 correspond to the invention while formulations C1 and C2 are intended for comparison. The results are set out in Table 1.

TABLE 1

Höppler viscosity of the aqueous surfactant systems at 20° C. (quantities in % by weight, based on active substance)

| | 1 | 2 | 3 | 4 | C1 | C2 |
|---|---|---|---|---|---|---|
| Fatty acid methyl ester A) | 1.8 | — | — | — | — | — |
| Fatty acid methyl ester B) | — | 1.8 | — | — | — | — |
| Fatty acid methyl ester C) | — | — | 1.8 | — | — | — |
| Fatty acid methyl ester D) | — | — | — | 1.8 | — | — |
| $C_{12/14}$ fatty alcohol + 1.3 EO sulfate, sodium salt | 13.5 | 13.5 | 13.5 | 13.5 | 13.5 | 13.5 |
| Lauric acid monoethanolamide | 0.7 | 0.7 | 0.7 | 0.7 | 0.7 | 0.7 |
| Dimethyl-N-cocoalkyl ammonium betaine | 2 | 2 | 2 | 2 | 2 | 2 |
| $MgSO_4.7H_20$ | 1 | 1 | 1 | 1 | 1 | 1 |
| $C_{12/14}$ fatty alcohol + 6 EO | — | — | — | — | — | 1.8 |
| Water | | | | to 100 | | |
| Viscosity (in mPas) | 500 | 715 | 195 | 90 | 1340 | 3080 |

The quantity of 1.8% by weight of fatty acid methyl ester used corresponds to 11.1% by weight, based on the active substance content of the surfactants.

What is claimed is:

1. A process for reducing the viscosity of an aqueous surfactant composition comprising:

(a) providing an aqueous surfactant composition containing at least one surfactant, other than an alkoxylated carboxylic acid ester;

(b) providing a viscosity-reducing agent corresponding to formula (I):

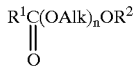

(I)

wherein $R^1CO$ is an aliphatic acyl group containing from 6 to 18 carbon atoms, AlkO represents $CH_2CH_2O$—, $CHCH_3CH_2O$—, $CH_2$—$CHCH_3O$, n is a number from 3 to 15, and $R^2$ is an aliphatic alkyl group having from 1 to 22 carbon atoms; and (c) adding a viscosity-reducing effective amount of the viscosity-reducing agent to the aqueous surfactant composition.

2. The process of claim 1 wherein the viscosity-reducing agent is derived from a carboxylic acid reacted with an alkylene oxide in the presence of a calcined hydrotalcite.

3. The process of claim 1 wherein in formula (I) $R^1CO$ is an aliphatic acyl group having from 6 to 10 carbon atoms, OAlk is $CH_2CH_2O$, n is a number from 5 to 15 and $R^2$ is a methyl group.

4. The process of claim 1 wherein in formula (I) $R^1CO$ is an aliphatic acyl group having from 12 to 14 carbon atoms, OAlk is $CH_2CH_2O$, n is a number from 8 to 12 and $R^2$ is a methyl group.

5. The process of claim 1 wherein the viscosity-reducing agent is present in the aqueous surfactant composition in an amount of from about 0.1 to 20% by weight, based on the surfactant active substance content of the composition.

6. The process of claim 1 wherein the aqueous surfactant composition contains an anionic surfactant selected from the group consisting of an alkyl sulfate, an alkyl ether sulfate, an alkane sulfonate, a monoglyceride sulfate, a sulfosuccinate, a fatty acid polyglycol ester sulfate, and mixtures thereof.

7. The process of claim 1 wherein the aqueous surfactant composition contains a nonionic surfactant selected from the group consisting of a fatty alcohol polyglycol ether, an alkyl/alkenyl oligoglycoside, an amine oxide, a fatty acid-N-alkyl polyhydroxyalkylamide, and mixtures thereof.

8. The process of claim 1 wherein the aqueous surfactant composition contains an amphoteric or zwitterionic surfactant selected from the group consisting of an alkyl betaine, an alkyl amidobetaine, and mixtures thereof.

9. The process of claim 1 wherein the viscosity-reducing agent is present in the composition in an amount of from about 5 to 15% by weight, based on the surfactant active substance content of the composition.

10. The process of claim 1 wherein the composition contains from about 10 to 45% by weight of at least one surfactant, based on the active substance content of the composition.

11. The process of claim 1 wherein the composition contains from about 10 to 40% by weight of at least one surfactant, based on the active substance content of the composition.

12. The process of claim 1 wherein the composition contains from about 15 to 40% by weight of at least one surfactant, based on the active substance content of the composition.

* * * * *